US007398582B1

(12) United States Patent
VerPlank

(10) Patent No.: US 7,398,582 B1
(45) Date of Patent: Jul. 15, 2008

(54) BURIAL CASKET WITH SECURITY LOCK

(75) Inventor: Joel VerPlank, Florence, AL (US)

(73) Assignee: Verplank Enterprises, Inc., Iron City, TN (US)

( * ) Notice: Subject to any disclaimer, the term of this patent is extended or adjusted under 35 U.S.C. 154(b) by 0 days.

(21) Appl. No.: 11/789,166

(22) Filed: Apr. 24, 2007

(51) Int. Cl.
*A61G 17/00* (2006.01)

(52) U.S. Cl. ..... 27/17; 27/DIG. 1; 292/160; 292/153

(58) Field of Classification Search ..... 27/17, 27/DIG. 1, 14; 292/160, DIG. 53, 156, 157, 292/162, 142, 145, 153
See application file for complete search history.

(56) References Cited

U.S. PATENT DOCUMENTS

| | | | | |
|---|---|---|---|---|
| 2,417,756 | A * | 3/1947 | Hillenbrand | 292/157 |
| 2,830,355 | A * | 4/1958 | Christian | 27/17 |
| 3,094,346 | A * | 6/1963 | Baker, Jr. | 292/5 |
| 3,944,267 | A | 3/1976 | Sundquist | |
| 3,981,054 | A | 9/1976 | Hull et al. | |
| 4,486,040 | A | 12/1984 | Strangward | |
| 4,523,358 | A | 6/1985 | Semon | |
| 5,060,993 | A | 10/1991 | Maier | |
| 5,265,923 | A | 11/1993 | Paddock | |
| 5,457,861 | A | 10/1995 | Lloyd | |
| 5,503,439 | A | 4/1996 | LaJeunesse et al. | |
| 5,875,529 | A | 3/1999 | Ollier | |
| 5,956,825 | A | 9/1999 | McCoy et al. | |
| 5,966,786 | A | 10/1999 | Bowling | |
| 6,101,692 | A | 8/2000 | Linville et al. | |
| 6,152,499 | A * | 11/2000 | Robert | 292/153 |
| 6,154,938 | A | 12/2000 | LaJeunesse et al. | |
| 6,364,377 | B1 | 4/2002 | Ferguson | |
| 6,385,824 | B1 | 5/2002 | Schwartz | |
| 6,574,841 | B1 | 6/2003 | Vosahlik et al. | |
| 6,898,830 | B1 | 5/2005 | Acton et al. | |
| 6,904,651 | B2 | 6/2005 | Pontone et al. | |
| 7,014,227 | B2 | 3/2006 | Strangward et al. | |
| 7,181,814 | B1 * | 2/2007 | Palmer | 27/17 |
| 2004/0222644 | A1 | 11/2004 | Strangward et al. | |

* cited by examiner

*Primary Examiner*—William L. Miller
(74) *Attorney, Agent, or Firm*—Waddey & Patterson; Edward D. Lanquist, Jr.; Dennis H. Nunez

(57) ABSTRACT

The invention is a lockable burial casket. The lockable burial casket contains a lockable obstruction device for blocking the movement of the bar. The bar is supported by a bracket mounted on the casket. This bracket may contain a groove along the path of movement of the bar. When the catches on the bar engage connectors on the lid, the lockable obstruction device can be placed into a locking position which prevents the catches from unengaging the connectors on the lid. This may be done by inserting the lockable obstruction device within the groove.

20 Claims, 3 Drawing Sheets

BURIAL CASKET WITH SECURITY LOCK

BACKGROUND OF THE INVENTION

The present invention relates generally to a mechanism for locking the lid of a burial casket.

At a person's funeral, family members often commemorate a person's life by placing items and other memorabilia within the deceased's burial casket. This memorabilia is valuable and often requires protection from thieves. Furthermore, family members also desire a sense of security that the remains of the deceased and the memorabilia inside the casket will not be tampered with after and throughout the burial process.

Burial caskets often come with a slidable bar having a catch which engages a connector on the lid of the burial casket. In this manner, the lid of the burial casket is latched and secured shut. However, anybody having access to the device which moves the bar may slide the bar out of the latched position. What is required is a device which prevents the bar from moving out of the latched position even if a thief has access to the device for moving the slidable bar.

BRIEF SUMMARY OF THE INVENTION

The lockable burial casket of the present invention has a body portion defining a cavity for receiving the body of the deceased. The cavity's opening is closed by a lid pivotally connected to the body portion. A bar latches the lid to the body portion and is supported by a bracket. In order to latch the lid, the bar moves along the body portion until a catch on the bar engages a connector on the lid. In order to maintain the lid in the latched position, the device comes equipped with a lockable obstruction device. When the obstruction device is in a locked position, the device obstructs the movement of the bar and thereby prevents the bar from moving out of the latched position.

Accordingly one of the objects of the present invention is to provide a mechanism for protecting the contents of a burial casket.

Another object of the present invention is to provide a mechanism for locking the burial casket.

Still another object of the present invention is to lock the bar on the burial casket in a latched position.

DETAILED DESCRIPTION OF THE INVENTION

Figure 1:
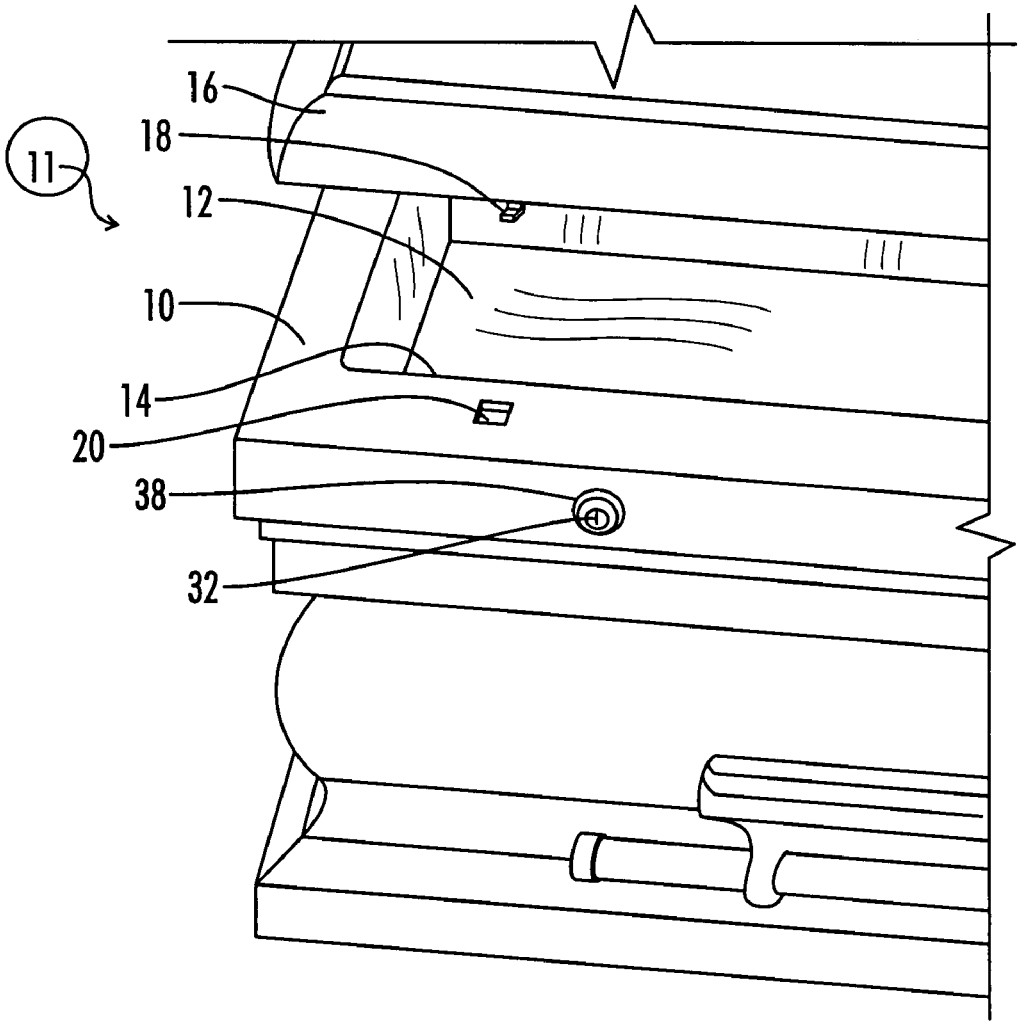
FIG. 1 is a perspective view of the outside of a lockable burial casket.
Figure 2:
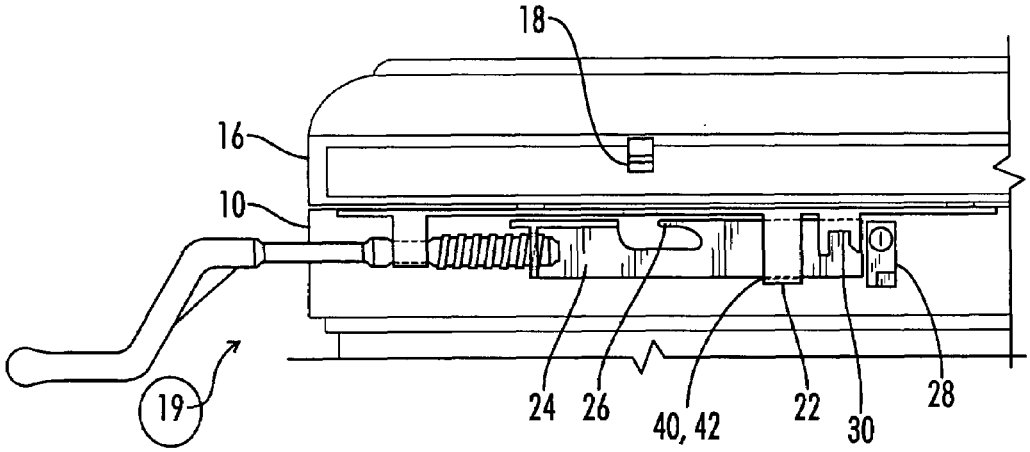
FIG. 2 is a side view of the latching mechanism and lockable obstruction device of the embodiment in FIG. 1.

Referring now to FIGS. 1 and 2, a lockable burial casket 11 is shown. The lockable burial casket 11 has a body portion 10 defining a cavity 12 for receiving the body of the deceased. The body of the deceased is received within the cavity 12 through an opening 14. Family members often place valuables and other memorabilia within the cavity 12. Thus, family members desire peace of mind that nobody will tamper with the contents of the burial casket or the remains of the deceased. In order to close the opening 14, a lid 16 is pivotally connected to the body portion 10. A connector 18 is mounted on the lid 16 to engage a latching mechanism 19.

In the preferred embodiment, a latching mechanism 19 (see FIG. 2) is concealed within the body portion 10. However, the latching mechanism 19 can be mounted on the body portion 10 at any location so long as the latching mechanism 19 operates to latch the lid 16 to the body portion 10. Referring specifically to FIG. 2, the latching mechanism 19 has a bracket 22, and a bar 24 supported by the bracket 22. In order to engage the connector 18 with the latching mechanism 19, the connector 18 may be placed into the body portion through the connector insertion aperture 20 shown in FIG. 1. The bar 24 is movable along the body portion 10 to a latched position wherein the catch 26 engages the connector 18 when the lid 16 is closed. Although only one catch and connector are shown in the figures, the lid 16 and the bar 24 may have several connectors and several catches for latching the lid 16 along the body portion 10.

In order to lock the lid shut, the burial casket 11 has a lockable obstruction device 28. This lockable obstruction device 28 is movable into a locked position wherein the device 28 obstructs the movement of the bar 24. By obstructing the movement of the bar 24, the lockable obstruction device 28 prevents the bar 24 from moving out of the latched position thereby locking the lid 16 onto the body portion 10. In this manner, the deceased and memorabilia within the lockable burial casket 11 are safe from unwanted tampering and thieves. In the preferred embodiment, the bracket 22 defines a slidable passage 40 for moving the bar 24 along the body portion 10. The lockable obstruction device 28 obstructs the sliding of the bar within this passage 40 when the obstruction device 28 is in the locked position thereby locking the casket.

Figure 3:
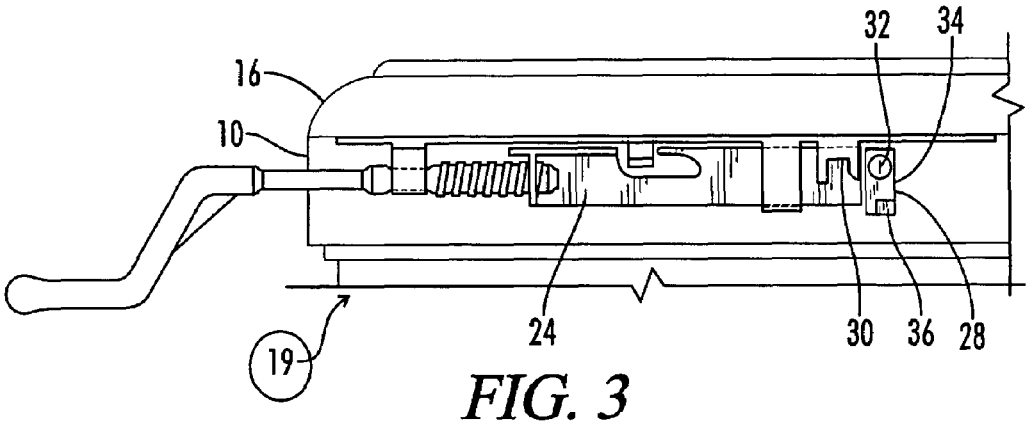
FIG. 3 is a side view of the latching mechanism and lockable obstruction device within the lockable burial casket. The slidable bar is in an unlatched position and the lockable obstruction device is in an unlocked position.
Figure 4:
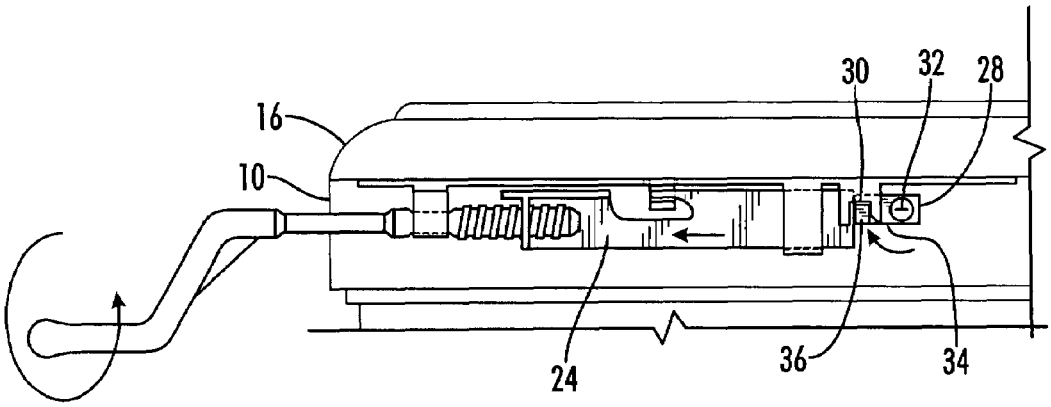
FIG. 4 is a side view similar to FIG. 3, but showing the lockable obstruction device in a locked position.

Referring now to FIGS. 3 and 4, the latching mechanism is shown mounted within the body portion 10 of the lockable burial casket 11. FIG. 3 shows the bar 24 in an unlatched position with the lockable obstruction device 28 in an unlocked position. Normally, the groove 30 and the lockable obstruction device 28 are placed near the end of the bar 24. As can be seen, in the unlatched position the bar 24 obstructs the groove 30 thereby preventing the lockable obstruction device 28 from entering the groove 30. In this manner, the lockable obstruction device 28 cannot lock the burial casket 11 unless the bar 24 is moved into the latched position.

Referring to FIG. 4, the bar is shown moved into the latched position so that the bar 24 no longer obstructs the groove 30. In the latched position, the catch 26 is in position to engage the connector on the lid 16. Since the bar 24 no longer obstructs the groove 30, the lockable obstruction device 28 can be inserted into the groove 30 when the lockable obstruction device 28 is in the locked position. In this manner, the slidable bar 24 runs into or is obstructed by the lockable obstruction device 28 if the bar 24 is attempted to be slid out of the latched position. Thus, even if a person had access to the mechanism for moving the bar 24, the bar 24 could not be slid out of the latched position.

Any lockable obstruction device is functional with this invention so long as the lockable obstruction device can obstruct the movement of the bar 24 when the lockable obstruction device is in a locked position. However, in the preferred embodiment, the lockable obstruction device 28 is a security cabinet lock or a device similar to a security cabinet lock. The lockable obstruction device 28 has a rotatable key slot 32 and an arm 34. A key can be placed into the rotatable key slot 32 so that the key slot 32 rotates the arm 34. Preferably, at the end of the arm 34 is an obstruction member 36 which is insertable into the groove 30. In order to accommodate the lockable obstruction device 28, the body portion 10 of the lockable burial casket 11 may have an aperture 38 (FIG. 1) for inserting the key slot 32. In the preferred embodiment, the key slot 32 is inserted through the aperture 38 so that the arm 34 can be rotated from the outside of the lockable burial casket 11. In this manner, the latching mechanism remains within the body portion, while a person can lock the lockable obstruction device from the outside of the casket.

Referring again to FIG. 2, the bracket 22 may have slotted supports 42 for supporting the bar 24. These slotted supports 42 may define the slidable passage within the bracket 22. In the preferred embodiment, the groove 30 is defined by one of these slotted supports 42 on the bracket 22. This shows the preferred method of defining the slidable passage 40 and the groove 30 in the invention.

Figure 5:
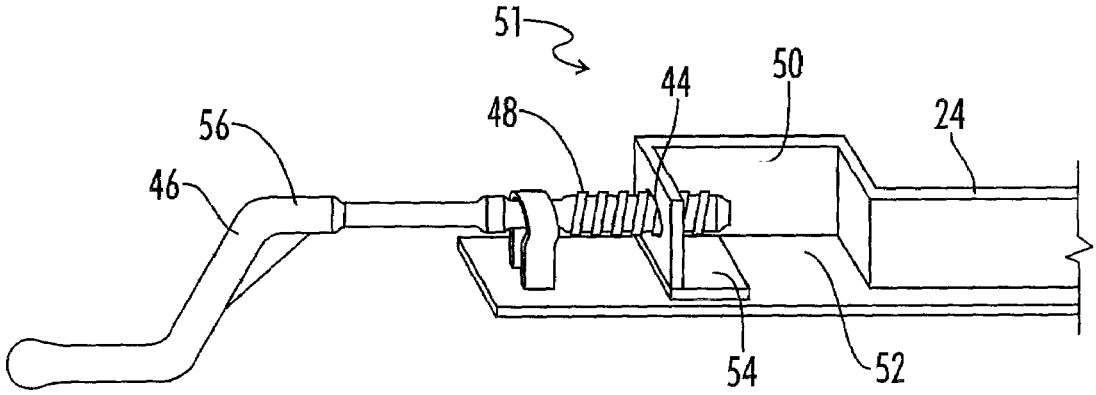
FIG. 5 is a perspective view of the device for moving the bar into the latched position.

Referring specifically to FIG. 5, a typical bar sliding mechanism 51 is shown for sliding the bar 24 into and out of the latched position. The sliding mechanism 51 has a crank 46 and an extended portion 50 attached to the bar 24. The crank 46 is made of two separable pieces; a rotatable threaded portion 48 and a crank handle 56 for rotating the threaded portion 48. The rotatable threaded portion 48 is fixed to the bracket 22 and is inserted into a crank aperture 44 on the extended portion 50. Since the rotatable threaded portion 48 is fixed to the bracket 22, rotating the threaded portion 48 causes the crank aperture 44 on the extended portion 50 to be moved up or down the threads of the threaded portion 48. This causes the bar 24 to be slid into or out of the latching position depending on the direction of rotation.

Once the bar 24 is in the latched position, the crank handle 56 is separated from the threaded portion 48. However, simply separating the crank handle 56 from the threaded portion 48 does not secure the contents of the casket 11. A thief or vandal could simply attach the crank handle 56 to the threaded member 48 and slide the bar 24 out of the latched position to open the casket 11. By adding the lockable obstruction device 28, the device 28 obstructs the movement of the bar 24 when the device 28 is in the locked position thereby preventing the bar 24 from moving out of the latched position. Thus, even if the thief or vandal had access to the crank handle 56, the bar 24 would not be able to move out of the latched position. The lockable obstruction device 28 thus locks the casket 11 shut.

Referring again to FIG. 5, the sliding mechanism 51 may have a sliding member 52 attached to the extended portion 50. This extended portion 50 may be attached to the sliding member 52 via attachment portion 54. As the crank 46 is turned, the sliding member 52 may be inserted into a second slidable passage (not shown) within the burial casket 11 defined in bracket 22.

Thus, although there have been described particular embodiments of the present invention of a new and useful BURIAL CASKET WITH SECURITY LOCK, it is not intended that such references be construed as limitations upon the scope of this invention except as set forth in the following claims.

What is claimed is:

1. A lockable burial casket, comprising:

a body portion defining a cavity wherein the cavity has an opening;

a lid pivotally connected to the body portion to close the opening;

a connector mounted on the lid;

a bracket mounted on the body portion;

a bar supported by the bracket and having a catch, the bar being movable along the body portion to a latched position wherein the catch engages the connector when the lid is closed; and a lockable obstruction device mounted on the body portion, the lockable obstruction device being movable into a locked position wherein the device obstructs the movement of the bar thereby preventing the bar from moving out of the latched position.

2. The lockable burial casket of claim 1, further comprising:

the bar defining a crank aperture; and a crank having a threaded member inserted into the crank aperture wherein rotating the crank moves the bar into the latched position.

3. The lockable burial casket of claim 1, wherein:

the bracket defines a groove; and the lockable obstruction device being insertable into the groove in the locked position to obstruct the movement of the bar.

4. The lockable burial casket of claim 3, wherein the lockable obstruction device further comprises:

a rotatable key slot; and an arm having an obstruction member wherein the arm is linked to the key slot so that the key slot rotates the obstruction member into the groove when the slidable bar is in the latched position.

5. The lockable burial casket of claim 4, wherein the body portion defines an aperture and the rotatable key slot is inserted into the aperture.

6. The lockable burial casket of claim 1, further comprising:

the lid having more than one connector; and the bar defining more than one catch, wherein each catch engages one of the connectors when the bar is in the latched position.

7. A lockable burial casket, comprising:

a body portion defining a cavity wherein the cavity has an opening;

a lid pivotally connected to the body portion to close the opening;

a connector mounted on the lid;

a bracket mounted on the body portion and defining a slidable passage;

a bar having a catch and being received within the passage, the bar being slidable within the passage to a latched position wherein the catch engages the connector when the lid is closed; and a lockable obstruction device mounted on the body portion, the lockable obstruction device obstructing the sliding of the bar within the passage when the obstruction device is in a locked position such that the bar is prevented from sliding out of the latched position.

8. The lockable burial casket of claim 7, wherein:

the bracket defines a groove traversing the slidable passage; and the bar intersects the groove in an unlatched position, the catch being unengaged from the connector in the unlatched position.

9. The lockable burial casket of claim 8, wherein:

the groove is unobstructed by the bar when the bar is in the latched position; and the lockable obstruction device is received in the groove in the locked position thereby preventing the bar from sliding out of the latched position.

10. The lockable burial casket of claim 7, wherein the lockable obstruction device further comprises a keyed lock for locking the obstruction device in the locked position.

11. The lockable burial casket of claim 10, wherein the body portion defines a keyed lock aperture for inserting the keyed lock.

12. The lockable burial casket of claim 7, wherein the bracket defines an insertion aperture for inserting the connector through the bracket.

13. The lockable burial casket of claim 7, further comprising:

the bar having an extended portion defining a crank aperture; and a crank having a threaded portion inserted into the crank aperture such that turning the crank slides the bar into the latched position.

14. The lockable burial casket of claim 13, further comprising:

a sliding member for sliding within the burial casket, the sliding member being attached to the extended portion wherein turning the crank slides the sliding member when the sliding member is inserted into the casket.

15. The lockable burial casket of claim 13, wherein the crank further comprises a rotatable handle portion for rotating the threaded member wherein the handle portion and the member are separable.

16. A lockable burial casket, comprising:

a body portion defining a cavity wherein the cavity has an opening;

a lid pivotally connected to the body portion to close the opening;

a connector mounted on the lid;

a bracket mounted on the body portion and defining a slidable passage wherein the bracket defines a groove intersecting the passage;

a bar having a catch for engaging the connector on the lid when the lid is closed, the bar being received within the passage and being slidable from an unlatched position to a latched position, wherein the bar obstructs the groove and the catch does not engage the connector in the unlatched position and wherein the bar is slid past the groove such that the catch engages the connector in the latched position; and a lockable obstruction device mounted on the body portion, the lockable obstruction device having a locked position wherein the obstruction device obstructs the groove when the bar is in the latched position such that the bar cannot slide into the unlatched position.

17. The lockable burial casket of claim 16, further comprising the bracket having a slotted support defining the slidable passage.

18. The lockable burial casket of claim 17, wherein the slotted support defines the groove.

19. The lockable burial casket of claim 18, wherein the lockable obstruction device further comprises:

a rotatable key slot; and an arm having an obstruction member wherein the arm is linked to the key slot so that the key slot rotates the obstruction member into the groove when the slidable bar is in the latched position.

20. The lockable burial casket of claim 19, wherein the body portion defines an key slot aperture, the rotatable key slot being inserted into the aperture.

* * * * *